US006343551B2

(12) United States Patent
Kamiyama et al.

(10) Patent No.: US 6,343,551 B2
(45) **Date of Patent: *Feb. 5, 2002**

(54) SUPPORT STRUCTURE FOR CYLINDER

(75) Inventors: Jun Kamiyama; Tomoyuki Hayasaka, both of Toride (JP)

(73) Assignee: Komori Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/773,626

(22) Filed: Feb. 2, 2001

(30) Foreign Application Priority Data

Feb. 2, 2000 (JP) ..... 2000-025062

(51) Int. Cl.[7] ..... B41F 1/30; B41F 21/00

(52) U.S. Cl. ..... 101/409; 101/232; 101/352.03; 101/424

(58) Field of Search ..... 101/352.03, 232, 101/409; 493/424

(56) References Cited

U.S. PATENT DOCUMENTS 3,470,816 A 10/1969 Piecha et al.
5,924,970 A * 7/1999 Wingate ..... 493/424
6,058,837 A * 5/2000 Kamoda ..... 101/352.03
6,082,260 A * 7/2000 Friedrichs et al. ..... 101/232

* cited by examiner

*Primary Examiner*—John S. Hilten
*Assistant Examiner*—Marvin P. Crenshaw

(57) ABSTRACT

A support structure for a plate cylinder is composed of a pair of support frames; a pair of eccentric slide bearings rotatably supported on the support frames; a pair of eccentric roller bearings rotatably supported by the eccentric slide bearings and rotatably supporting end portions of a shaft of the plate cylinder; dogs and pinions for rotating the eccentric slide bearings relative to the support frames in the same amount; an annular plate, a casing, a drive shaft, a worm wheel, a worm gear, a threaded shaft, a support member, a connecting rod, and a connecting pin for rotating one of the eccentric roller bearings relative to one of the support frames; and an annular plate, a connecting rod, and connecting pins for restraining rotation of the other eccentric roller bearing relative to the other support frame. The support structure prevents occurrence of a difference between the amounts of movement of the axis on the operation side of the plate cylinder and the axis on the drive side of the plate cylinder during adjustment of the printing pressure, thus preventing cocking of the plate cylinder.

3 Claims, 5 Drawing Sheets

SUPPORT STRUCTURE FOR CYLINDER

BACKGROUND OF THE INVENTION

1. Field of the Invention

This invention relates to a support structure for a cylinder, and particularly, a support structure which is very useful when applied in supporting a plate cylinder of a printing press.

2. Description of the Related Art

A conventional support structure for a plate cylinder of a printing press will be explained with reference to FIGS. 3 to 5. FIG. 3 is a side view showing a support structure on an operation side of a plate cylinder. FIG. 4 is a sectional view of FIG. 3. FIG. 5 is a side view showing a support structure on a drive side of the plate cylinder. As shown in FIGS. 3 and 4, an eccentric slide bearing 11*a*, which is a first eccentric bearing having an external diameter and an internal diameter different in axis position, is rotatably supported on a support frame 10*a* on the operation side. An outer race 12*aa* of an eccentric roller bearing 12*a*, which is a second eccentric bearing with different axis positions of the outer race 12*aa* and an inner race 12*ab*, is rotatably supported by the eccentric slide bearing 11*a*. The inner race 12*ab* of the eccentric roller bearing 12*a* supports an end portion of a shaft on the operation side of a plate cylinder 101. A fan-shaped dog 13*a* having a tooth space in an outer peripheral portion thereof is attached to an edge portion of the eccentric slide bearing 11*a*. The dog 13*a* is engaged with a pinion 14*a*, and the pinion 14*a* is rotated by a drive source (not shown). An annular plate 15 is attached to an end portion of the outer race 12*aa* of the eccentric roller bearing 12*a*. The annular plate 15 has the same dimensions as the internal and external diameters of the outer race 12*aa*, and has a flange 15*a*.

As shown in FIG. 3, a casing 16 is attached to the support frame 100*a*. Inside the casing 16, a drive shaft 17 having an axis in a direction perpendicular to the axial direction of the plate cylinder 101 is rotatably supported. To the drive shaft 17, a worm wheel 18 is attached coaxially with the drive shaft 17. The worm wheel 18 is engaged with a worm gear 19. The worm gear 19 is rotated by a drive source (not shown). A base end portion (lower end portion) of a threaded shaft 20 is screwed to a front end portion (upper end portion) of the drive shaft 17. The threaded shaft 20 is rotatably supported by a support member 21 fixed to the support frame 100*a*. A base end portion of a connecting rod 22 is connected to a front end portion (upper end portion) of the threaded shaft 20. A front end portion of the connecting rod 22 is rotatably connected to the flange 15*a* of the annular plate 15 via a connecting pin 23. A rotary encoder 24 is connected to a base end portion (lower end portion) of the drive shaft 17. The annular plate 15, casing 16, drive shaft 17, worm wheel 18, worm gear 19, threaded shaft 20, support member 21, connecting rod 22, and connecting pin 23, which have been described above, constitute second rotating means in the present conventional example.

As shown in FIG. 5, an eccentric slide bearing 11*b*, which is the other first eccentric bearing having an external diameter and an internal diameter different in axis position, is rotatably supported on a support frame 100*b* on the drive side. An outer race 12*ba* of a roller bearing 12*b*, which has the outer race 12*ba* and an inner race 12*bb* consistent in axis, is rotatably supported by the eccentric slide bearing 11b. The inner race 12*bb* of the roller bearing 12*b* supports an end portion of a shaft on the drive side of the plate cylinder 101. A fan-shaped dog 13b having a tooth space in an outer peripheral portion thereof is attached to an edge portion of the eccentric slide bearing 11*b*. The dog 13*b* is engaged with a pinion 14*b*. The pinion 14*b* is connected to the drive source that drives and rotates the pinion 14*a* on the operation side, and can be rotated in the same amount as is the pinion 14*a* on the operation side. These dogs 13*a*, 13*b*, the pinions 14*a*, 14*b*, and the drive source, which have been described above, constitute first rotating means in the present conventional example. The reference numeral 102 denotes a blanket cylinder.

According to the foregoing support structure, when the drive source is actuated to rotate the pinions 14*a*, 14*b* in the same amount, the eccentric slide bearings 11*a*, 11*b* are rotated via the dogs 13*a*, 13*b*. As a result, the axes Oa, Ob of the plate cylinder 101 move about the eccentric axes Oa1, Ob1 of the eccentric slide bearings 11*a*, 11*b* via the roller bearings 12*a*, 12*b*. Thus, the distance between the axes O, O of the blanket cylinder 102 and the axes Oa, Ob of the plate cylinder 101, namely, the distance between the outer peripheral surfaces of the blanket cylinder 102 and the plate cylinder 101 can be changed. By this measure, an object to be printed, such as a sheet, can be printed at an appropriate printing pressure in accordance with, for example, the thickness of the object to be printed. When the worm gear 19 is rotated to rotate the worm wheel 18, the drive shaft 17 rotates. In accordance with the rotation of the drive shaft 17, the threaded shaft 20 ascends or descends. As a result, the annular plate 15 rotates via the connecting rod 22 and the connecting pin 23, whereupon the outer race 12*aa* of the eccentric roller bearing 12*a* rotates. Thus, the axis Oa on the operation side of the plate cylinder 101 moves about the eccentric axis Oa2 of the eccentric roller bearing 12*a* via the inner race 12*ab*. That is, the axis Oa on the operation side of the plate cylinder 101 can be displaced relative to the axis of the blanket cylinder 102 about the axis Ob on the drive side of the plate cylinder 101. By this measure, displacement of the printing position in accordance with a change, for example, in the thickness of the object to be printed, such as a sheet, can be corrected.

In the above-described support structure, the second rotating means is connected only to the eccentric roller bearing 12*a* on the operation side of the plate cylinder 101. Thus, if it is attempted to adjust the printing pressure by actuating the first rotating means as stated earlier, rotation of the eccentric roller bearing 12*a* on the operation side of the plate cylinder 101 is restrained by the second rotating means. As a result, a difference arises between the amount of movement of the axis Oa on the operation side of the plate cylinder 101 and the amount of movement of the axis Ob on the drive side of the plate cylinder 101. This results in cocking of the plate cylinder 101.

SUMMARY OF THE INVENTION

The present invention has been accomplished to solve the above-described problem.

According to the present invention, there is provided a support structure for a cylinder, comprising:

- a pair of frames;
- a pair of first eccentric bearings rotatably supported on the frames;
- a pair of second eccentric bearings rotatably supported by the first eccentric bearings and rotatably supporting end portions of a shaft of the cylinder;
- first rotating means for rotating the first eccentric bearings relative to the frames in a same amount;

second rotating means for rotating one of the second eccentric bearings relative to one of the frames; and restraining means for restraining rotation of the other second eccentric bearing relative to the other frame.

In the above support structure, the restraining means may have a connecting rod having one end portion rotatably connected to the other second eccentric bearing, and having the other end portion rotatably connected to the other frame.

According to the cylinder support structure of the present invention, the restraining means restrains rotation of the other second eccentric bearing. As a result, the one second eccentric bearing and the other second eccentric bearing move in the same manner. Thus, there is no difference between the amount of movement of the axis at one end portion of the cylinder and the amount of movement of the axis at the other end portion of the cylinder. Consequently, no cocking occurs in the cylinder.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of the present invention will now be described in detail with reference to the accompanying drawings, but they in no way limit the invention.

Figure 1:
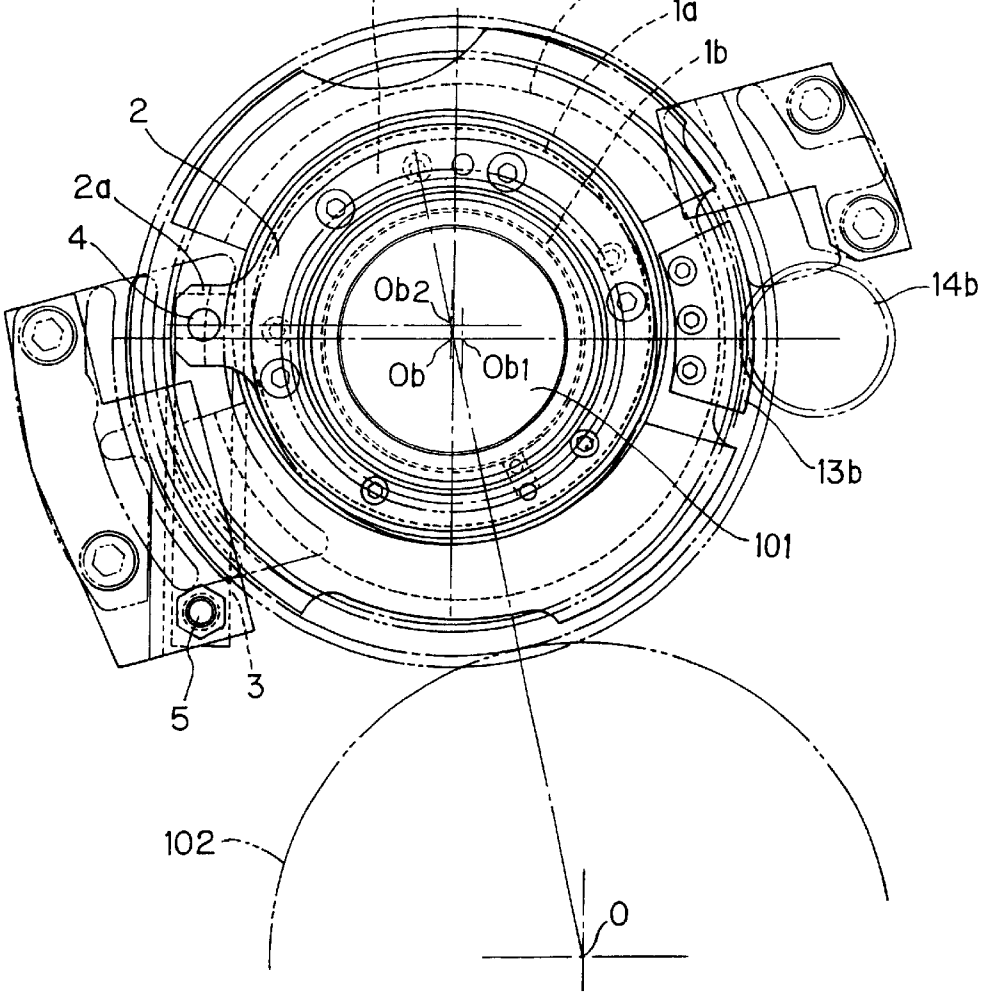
FIG. 1 is aside view showing a support structure for a cylinder according to the present invention, when viewed from a drive side, in an embodiment in which the support structure is applied as a support structure for a plate cylinder of a printing press.
Figure 2:
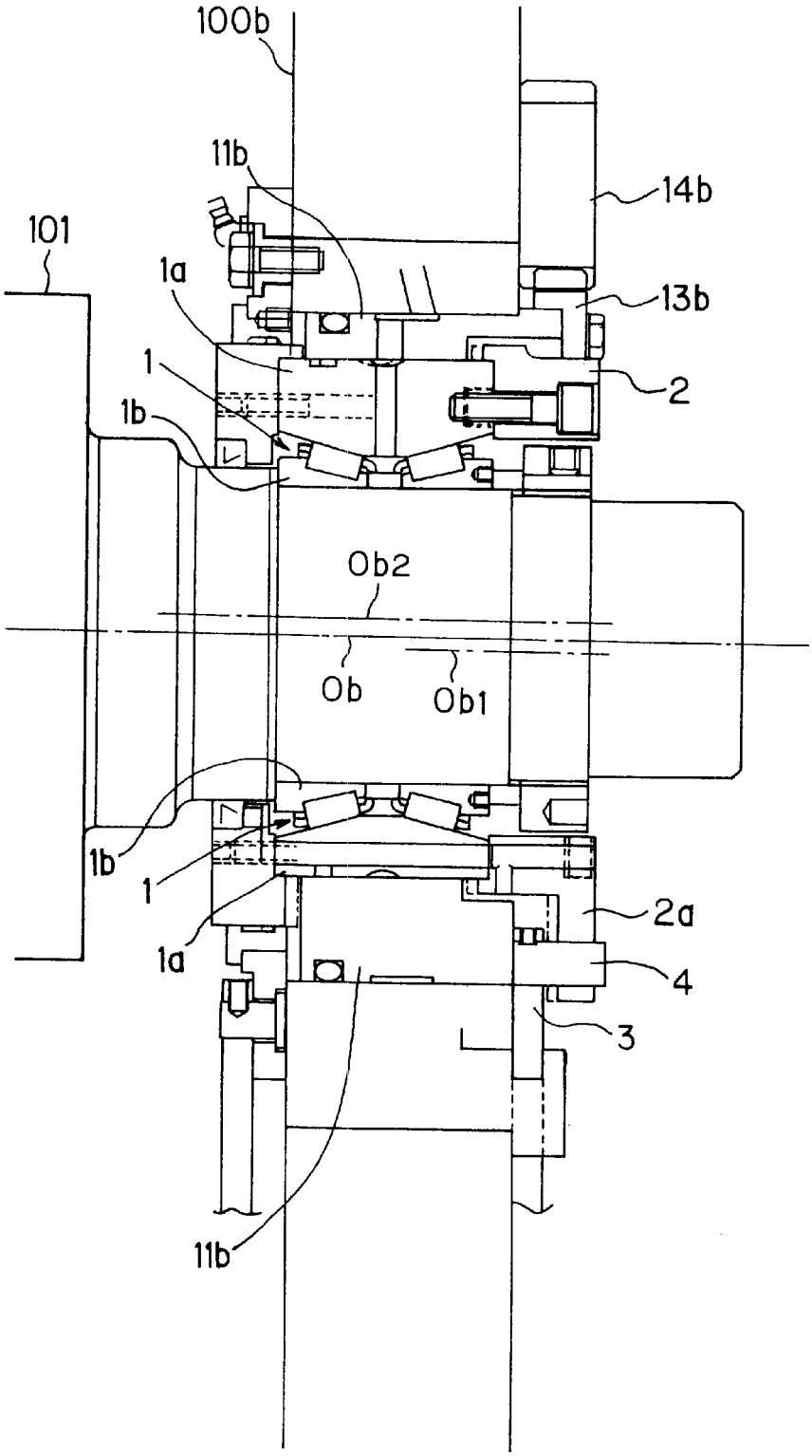
FIG. 2 is a sectional view of FIG. 1.
Figure 3:
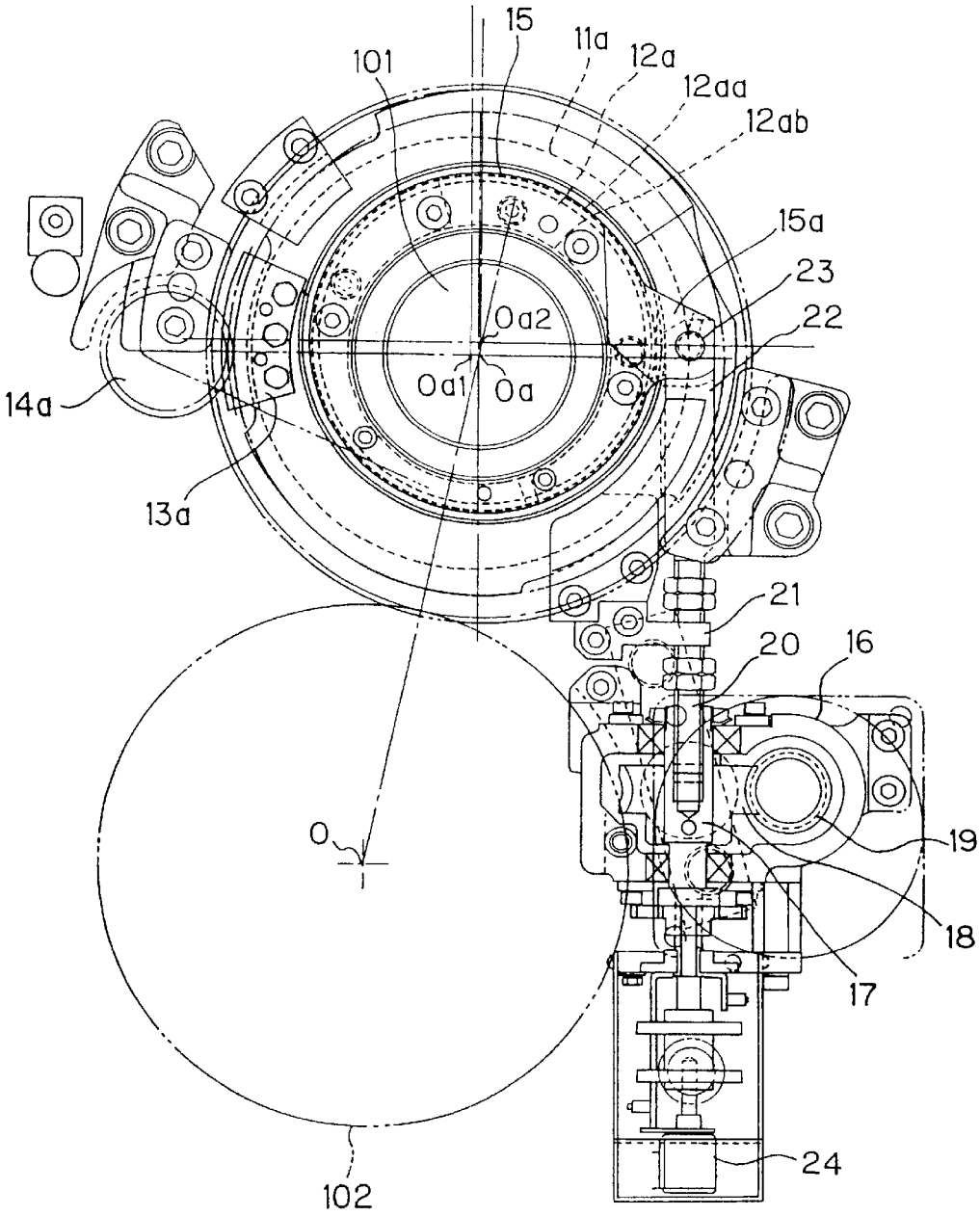
FIG. 3 RELATED ART
FIG. 3 is a side view showing a conventional support structure on an operation side of a plate cylinder of a printing press.
Figure 4:
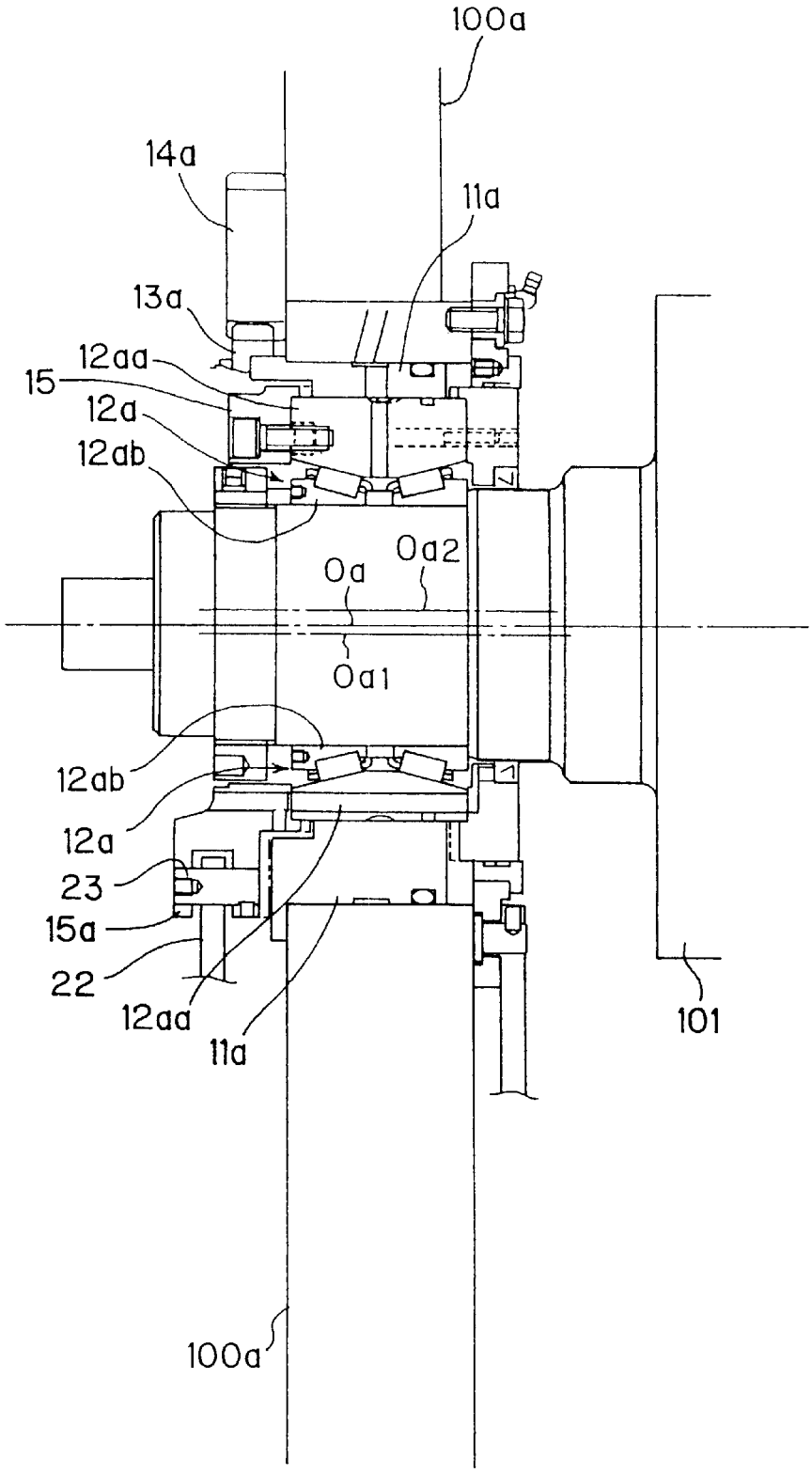
FIG. 4 RELATED ART
FIG. 4 is a sectional view of FIG. 3.
Figure 5:
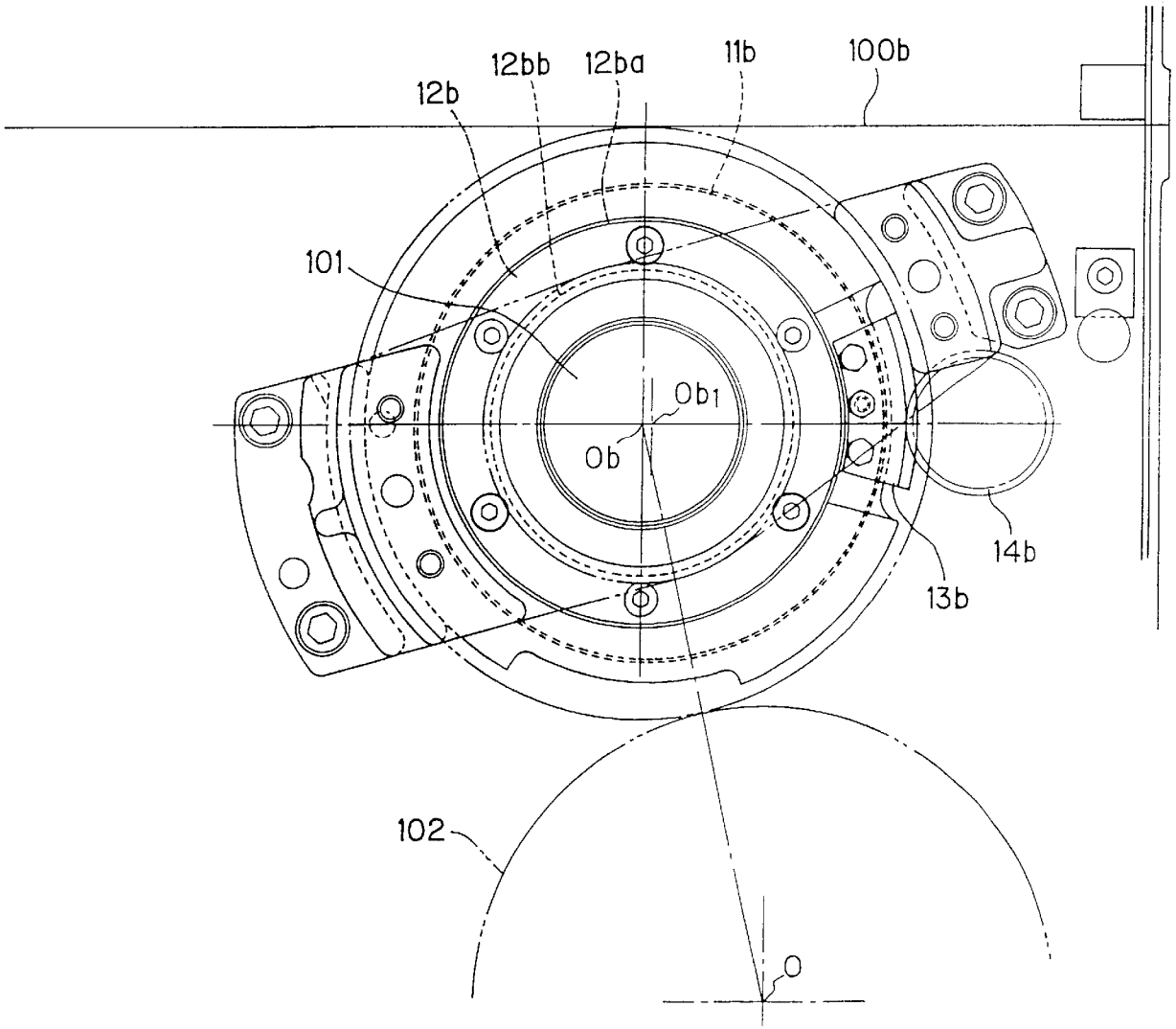
FIG. 5 RELATED ART
FIG. 5 is a side view showing a conventional support structure on the drive side of the plate cylinder of the printing press.

An embodiment in which a support structure for a cylinder according to the present invention is applied as a support structure for a plate cylinder of a printing press is explained using FIGS. 1 and 2. FIG. 1 is a side view showing a support structure on the drive side of the plate cylinder. FIG. 2 is a sectional view of FIG. 1. A support structure on the operation side of the plate cylinder is the same as the structure that has been explained in connection with the earlier technology. Thus, the description of the earlier technology is to be taken herein as an explanation for the support structure on the operation side of the plate cylinder.

As shown in FIGS. 1 and 2, an eccentric slide bearing 11*b*, which is the other first eccentric bearing having an external diameter and an internal diameter different in axis position, is rotatably supported on a support frame 100*b* on the drive side. An outer race 1*a* of an eccentric roller bearing 1, which is the other second eccentric bearing eccentric in the same manner as the aforementioned eccentric roller bearing 12*a* on the operation side, is rotatably supported by the eccentric slide bearing 11*b*. An inner race 1*b* of the eccentric roller bearing 1 supports an end portion of a shaft on the drive side of the plate cylinder 101. A fan-shaped dog 13*b* having a tooth space in an outer peripheral portion thereof is attached to an edge portion of the eccentric slide bearing 11*b*. The dog 13*b* is engaged with a pinion 14*b*. The pinion 14*b* is connected to the aforementioned drive source that drives and rotates the pinion 14*a* on the operation side, and can be rotated in the same amount as is the pinion 14*a* on the operation side. These dogs 13*a*, 13*b*, the pinions 14*a*, 14*b*, and the drive source, which have been described above, constitute first rotating means in the present embodiment.

An annular plate 2 is attached to an end portion of the outer race la of the eccentric roller bearing 1. The annular plate 2 has the same dimensions as the internal and external diameters of the outer race la, and has a flange 2*a*. A front end portion of a connecting rod 3 is rotatably connected to the flange 2*a* of the annular plate 2 via a connecting pin 4. A base end portion of the connecting rod 3 is rotatably connected to and supported by the support frame 100*b* on the drive side via a connecting pin 5. The annular plate 2, connecting rod 3, and connecting pins 4 and 5 described above constitute restraining means in the present embodiment.

According to the foregoing support structure, when the drive source is actuated to rotate the pinions 14*a*, 14*b* in the same amount, the eccentric slide bearings 11*a*, 11*b* are rotated via the dogs 13*a*, 13*b*. As a result, the axes Oa, Ob of the plate cylinder 101 move about the eccentric axes Oa1, Ob1 of the eccentric slide bearings 1*a*, 11*b* via the eccentric roller bearings 12*a*, 1. Thus, the distance between the axes O, O of the blanket cylinder 102 and the axes Oa, Ob of the plate cylinder 101, namely, the distance between the outer peripheral surfaces of the blanket cylinder 102 and the plate cylinder 101 can be changed. On this occasion, rotation of the eccentric roller bearing 12*a* on the operation side of the plate cylinder 101 is restrained by the second rotating means. However, the shaft end on the drive side of the plate cylinder 101 is supported by the same eccentric roller bearing 1 as that on the operation side. Furthermore, movement of the eccentric roller bearing 1 on the drive side is restrained by the restraining means in the same manner as is the eccentric roller bearing 12*a* on the operation side. Thus, no difference occurs between the amounts of movement of the axis Oa on the operation side and the axis Ob on the drive side of the plate cylinder 101, so that no cocking is caused to the plate cylinder 101 during adjustment of the printing pressure. That is, the support state on the drive side of the plate cylinder 101 is set to be the same as the support state on the operation side of the plate cylinder 101.

According to the support structure for the plate cylinder 101 described above, even when the printing pressure is to be adjusted by varying the distance between the outer peripheral surfaces of the blanket cylinder 102 and the plate cylinder 101, the amounts of movement of the axis Oa on the operation side and the axis Ob on the drive side of the plate cylinder 101 do not differ, nor does cocking occur in the plate cylinder 101. Hence, the printing pressure can be adjusted appropriately.

In the present embodiment, the pinions 14*a*, 14*b*are rotated by the same drive source. However, the pinions 14*a*, 14*b* can be rotated in the same amount by different drive sources. Alternatively, the pinions 14*a*, 14*b* can be rotated manually in the same amount.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A support structure for a cylinder, comprising:

a pair of frames;

a pair of first eccentric bearings rotatably supported on said frames;

a pair of second eccentric bearings rotatably supported by said first eccentric bearings and rotatably supporting end portions of a shaft of the cylinder;

first rotating means for rotating said first eccentric bearings relative to said frames in a same amount;

second rotating means for rotating one of said second eccentric bearings relative to one of said frames; and restraining means for restraining rotation of the other said second eccentric bearing relative to the other said frame.

2. The support structure for a cylinder as claimed in claim 1, wherein said restraining means has a connecting rod having one end portion rotatably connected to the other said second eccentric bearing, and having the other end portion rotatably connected to the other said frame.

3. The support structure for a cylinder as claimed in claim 1, wherein the rotating means for rotating said first eccentric bearings relative to said frames in a same amount includes dogs and pinions.

* * * * *